US006892920B2

(12) United States Patent
Kunreuther

(10) Patent No.: US 6,892,920 B2
(45) Date of Patent: May 17, 2005

(54) TWO-STAGE ACTUATION SYSTEM FOR TAG ATTACHING TOOL

(76) Inventor: Steven Kunreuther, 285 Central Park West, New York, NY (US) 10024

( * ) Notice: Subject to any disclaimer, the term of this patent is extended or adjusted under 35 U.S.C. 154(b) by 29 days.

(21) Appl. No.: 10/223,733

(22) Filed: Aug. 20, 2002

(65) Prior Publication Data

US 2004/0035904 A1 Feb. 26, 2004

(51) Int. Cl.[7] ..... B31F 5/00

(52) U.S. Cl. ..... 227/3; 227/4; 227/67; 227/43; 227/114; 227/116

(58) Field of Search ..... 227/3, 4, 67, 43, 227/114, 116

(56) References Cited

U.S. PATENT DOCUMENTS

| | | | | |
|---|---|---|---|---|
| 3,103,666 A | | 9/1963 | Bone | |
| 3,896,713 A | | 7/1975 | Mato | |
| 4,235,161 A | | 11/1980 | Kunreuther | |
| 4,237,779 A | * | 12/1980 | Kunreuther | 493/376 |
| 4,323,183 A | * | 4/1982 | Duchin | 227/3 |
| 4,456,123 A | | 6/1984 | Russell | |
| 4,556,123 A | | 12/1985 | Hargest, III | |
| 4,589,583 A | | 5/1986 | Kunreuther et al. | |
| 4,718,158 A | | 1/1988 | Block | |
| 4,781,378 A | | 11/1988 | Clinnin et al. | |
| 4,889,272 A | * | 12/1989 | Kunreuther | 227/4 |

* cited by examiner

*Primary Examiner*—Louis K. Huynh
*Assistant Examiner*—Michelle Lopez
(74) *Attorney, Agent, or Firm*—Epstein Drangel Bazerman & James, LLP; Robert L. Epstein

(57) ABSTRACT

Apparatus is provided for actuating a tag attaching tool of the type which dispenses plastic fasteners from a clip of fasteners in response to the depression of a trigger. Each of the fasteners has a T-bar. The fasteners are dispensed by severing the fastener from the clip and ejecting the T-bar of the fastener through the hollow slotted needle of the tool. The tag attaching tool is actuated in two stages. During the first actuation stage, the trigger of the tool is partially depressed as the tool and an abutment are moved relative to each other such that the lead fastener is severed from the clip of fasteners. During the second actuation stage, the trigger of the tool is depressed completely, as the tool and abutment are moved further toward each other, causing the severed fastener to be ejected from the hollow needle of the attaching tool.

4 Claims, 3 Drawing Sheets

FIG 3
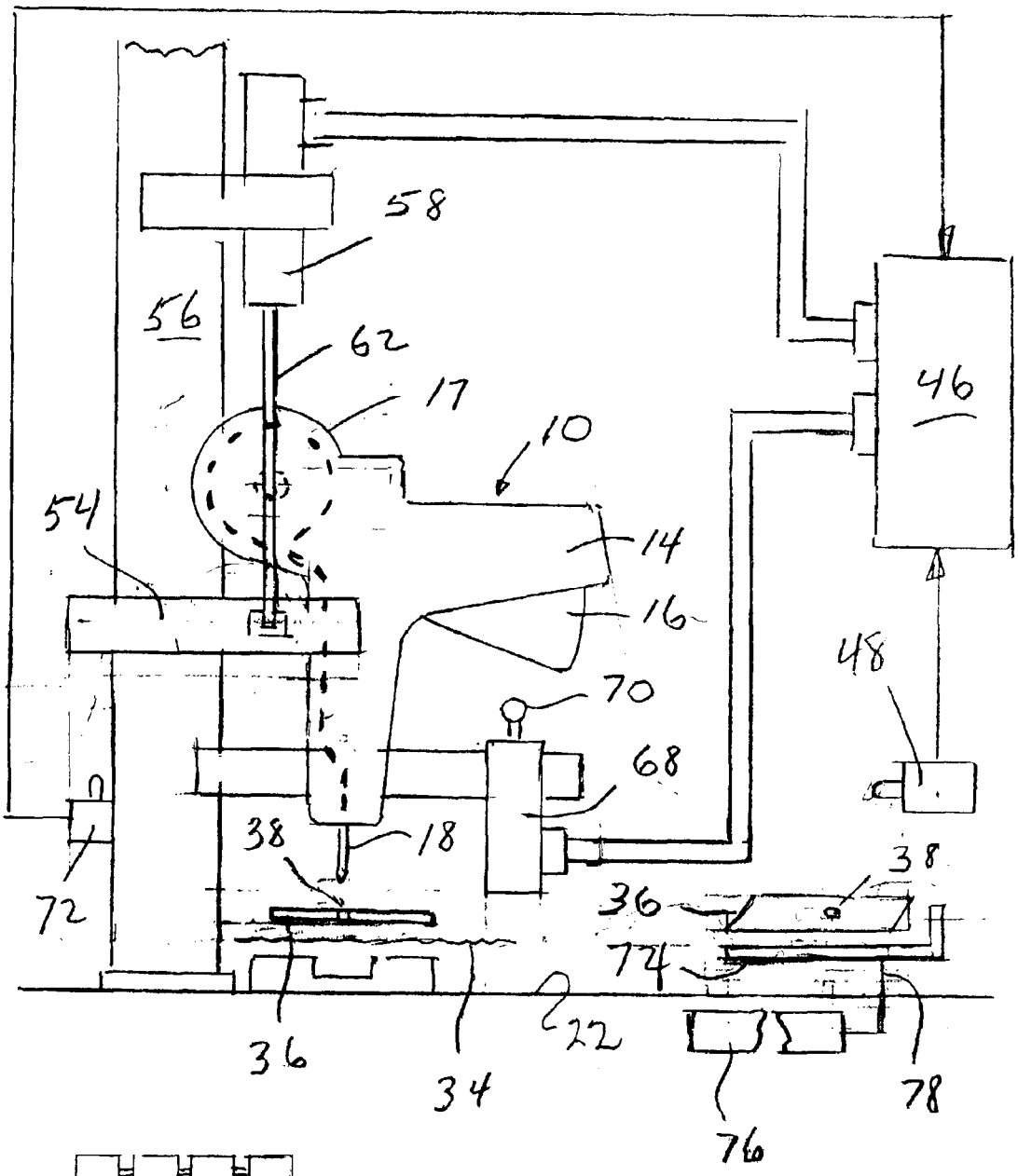
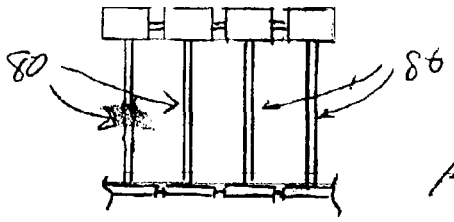
FIG 4

TWO-STAGE ACTUATION SYSTEM FOR TAG ATTACHING TOOL

The present invention relates to tools for attaching tags and the like to articles with plastic fasteners and more particularly to a system for automatically actuating a tag attaching tool in separate, sequential stages so as to eliminate breakage of the plastic fasteners as the fasteners are dispensed from the tool.

Tags of various types are utilized to label large quantities of many different types of articles, such as soft goods, including apparel of various types. One popular means of attaching tags to articles is by using plastic fasteners made of polypropylene or nylon, widely available from a number of sources. Such fasteners are provided with a T-bar at one end. The T-bar is connected to a second T-bar or an enlarged paddle, located at the other end of the fastener, by a thin, flexible filament. The filament is stretched during the fabrication process to give it a high tensile strength.

To attach a tag to an article, a tool with a gun-like housing having a protruding hollow slotted metal needle is utilized. The tool is supplied with a plurality of fasteners. The fasteners are either connected at spaced intervals along a connector or runner bar to form a clip, as disclosed in U.S. Pat. No. 3,103,666 issued Sep. 17, 1963 to Bone, entitled: Tag Attaching Device, or are connected directly to each other in roll form, as disclosed in U.S. Pat. No. 4,456,123 issued Jun. 26, 1984 to Russell, entitled: Method and Apparatus For Dispensing Fasteners, depending upon the type of tool being used. For simplicity, in this specification, we will refer to the fastener supply as a "clip" although it should be understood that the term "clip" is meant to include fasteners provided in roll form or any form of fastener supply. The clip of fasteners is received in a channel in the tool housing. The clip is advanced through the housing to bring the T-bar end of each fastener in turn into alignment behind the hollow needle.

The needle is inserted through a pre-punched opening in the tag and caused to penetrate the article to be tagged. The trigger of the tool is depressed, advancing a push rod to move the fastener to first sever the fastener from the clip and then to eject the T-bar of the fastener from the needle, such that the T-bar is situated on one side of the tag and article, the other end of the fastener is situated on the opposite side of the tag and article, with the filament extending therebetween, thereby anchoring the tag to the article.

Hand held tag attaching tools of this type are used widely and commercially available from a number of suppliers. Those devices may be manually operated or used with apparatus for automatically actuating the tool. When the tools are automatically actuated, they are often mounted on a work surface such as a table. Table mounted versions are also commonly utilized in conjunction with automatic tag feeding mechanisms which feed preprinted tags, one at a time, from a stack to the tool. Circuitry for controlling the tag feed and tool actuation operations is provided. See, for example: U.S. Pat. No. 3,896,713 entitled "Top-Feeding Automatic Tag-Attaching Machine" issued to Mato on Jul. 29, 1975; U.S. Pat. No. 4,235,161 entitled "Automatic Tag Attaching Apparatus" issued to Kunreuther on Nov. 25, 1980; U.S. Pat. No. 4,718,158 entitled "Automatic Tagging Apparatus and Method Therefor" issued to Charles Block on Jan. 12, 1988; and U.S. Pat. No. 4,781,318 entitled "Tagging Apparatus" issued to Ronald Meyers on Nov. 1, 1988.

Most automatic tagging machines available currently, such as those disclosed in the first three patents mentioned in the previous paragraph, employ a tag feed system which utilizes a pneumatically driven reciprocating slide mechanism. The slide moves preprinted tags, one at a time, from a stack in a hopper to a position where the pre-punched opening in the tag is aligned with the attaching tool needle. In the Mato and Block mechanisms, the tool and hence the needle is advanced toward the tag to insert the needle through the tag opening. In the Kunreuther machine, the attacher in a fixed position and tag is placed over the needle by moving the slide towards the needle, after the tag is properly aligned.

Other automatic tagging mechanisms utilize a fixed tag attaching tool like that of Kunreuther, but employ a moveable suction arm to engage the tag and place it on the needle. The arm carries a suction cup connected to a vacuum. The arm engages a tag in the hopper and transports the tag to the attacher needle. See U.S. Pat. No. 4,781,318, mentioned above. In the Meyers' apparatus, the vacuum arm is moved through a sinuous path that ends in a path section which is parallel to needle of the tag attaching tool, in order to place the tag over the needle.

The tag attaching tools used in all of these machines are actuated by depressing a trigger in the handle of the tool housing. The trigger is depressed by an extendable rod which forms a part of a pneumatic cylinder or an electric solenoid. If the tool is mounted in a fixed position, the rod is connected directly to the trigger. Movement of the rod depresses the trigger. If the tool is moveably mounted, the rod movement serves to advance the tool such that the trigger is depressed as it bears against a fixed abutment in the path of movement.

In either case, trigger depression is achieved with a single actuation of the cylinder or solenoid which serves both to sever the fastener from the clip and to eject the severed fastener through the needle. However, it has been found that depressing the trigger in this manner results in an unacceptably high number of fastener failures when polypropylene fasteners are used. This is because the force required to sever the fastener from the clip is relatively high. It is applied during the first portion of the trigger depression cycle. This force builds up until the fastener is severed and, during the second portion of the trigger depression cycle, the inertia of the moving parts resulting from the application of the high force during the first portion of the trigger depression cycle carries over into the second portion of the trigger depression cycle such that so much force is exerted on the fastener during the second portion of the trigger depression cycle that the T-bar is ejected from the needle in a way that often causes the T-bar to separate from the filament at the point where they are joined.

Fasteners made of polypropylene are relatively inexpensive but are vulnerable to breakage at the point where the T-bar is joined to the filament when too much force is applied. Fasteners made of nylon are stronger than polypropylene, and hence, less likely to break as the T-bar is ejected. However, nylon fasteners are considerably more expensive than those made of polypropylene. Therefore, there is a great deal of resistance to the use of nylon fasteners because of the extra expense when very large numbers of fasteners are utilized.

The system of my invention eliminates the breakage problem inherent in the use of polypropylene fasteners, eliminating the necessity for using the higher priced nylon fasteners. This is accomplished by separating the actuation cycle into two distinct stages, one for severing the fastener from the clip and the second for ejecting the T-bar from the needle. By adjusting the amount of force applied during each actuation stage, and the duration of each stage, to better match the requirements for the operation performed during each stage, and in particular to reduce the amount of force applied during the ejection portion of the cycle, separation of the T-bar from the filament as the T-bar is ejected from the needle can be virtually eliminated. This allows the use of the less expensive polypropylene fasteners.

It is, therefore, a prime object of the present invention to provide a two-stage actuation system for a tag attaching tool which virtually eliminates the breakage of polypropylene fasteners as they are ejected.

It is another object of the present invention to provide a two-stage actuation system for a tag attaching tool which eliminates the necessity of using higher priced nylon fasteners.

It is another object of the present invention to provide a two-stage actuation system for tag attaching tool which can be used with fixed and moveably mounted tag attaching tools.

It is another object of the present invention to provide a two stage actuation system for a tag attaching tool which permits the adjustment of the amount of force applied during each actuation stage, as well as the duration of each stage.

It is another object of the present invention to provide a two-stage actuation system for a tag attaching tool which can be used in a tag attaching machine with an automatic tag feeding mechanism either of the reciprocating slide or moveable vacuum arm type.

In accordance with one aspect of the present invention, apparatus is provided for actuating a tag attaching tool of the type which dispenses plastic fasteners from a clip in response to the depression of a trigger. Each of the fasteners has a T-bar. The fasteners are dispensed by severing the fastener from the clip and ejecting the T-bar from a hollow slotted needle. The apparatus comprises means for actuating the tool in two actuating stages. The first actuation stage severs the fastener from the clip. The second actuation stage ejects the fastener from the needle.

The tool actuating means includes first actuating means for depressing the trigger to sever the fastener from the clip during the first actuation stage and a second actuating means for ejecting the T-bar through the second actuation stage. The first means comprises means for partially depressing the attacher trigger. The second actuating means comprises means for completely depressing the attacher trigger. Means are provided for operating the first and second actuating means in sequence.

In situations where the attaching tool is moveably mounted, an abutment is aligned with the attacher trigger. The first actuating means includes means for advancing the attacher toward the abutment which is fixed. The second actuating means may include an extendable rod, also aligned with the trigger.

Alternatively, the first actuating means may include means for advancing the tool toward the abutment. The second actuating means may include an extendable rod. The rod functions as the abutment, during the first portion of the actuation cycle and to depress the trigger completely, during the second portion. Means are provided for operating the second actuating means to extend said rod. The operating means may include a switch actuated by the tool as it is advanced toward the abutment.

In situations where the tool is fixed, the first actuating means may include a first extendable rod operably connected to the attacher trigger. The second actuating means may include a second extendable rod operably connected to the attacher trigger. Means are provided for operating the first and the second means in sequence.

Automatic means for feeding tags, one at a time, to the needle, may also be provided. The automatic tag feeding means can be used whether the tool is fixed or moveably mounted.

In accordance with another aspect of the present invention, a method is provided for actuating a tag attaching tool of the type which has a hollow slotted needle and dispenses plastic fasteners from a clip in response to the depression of a trigger. The method includes the steps of operating a first actuating means to partially depressing the trigger to sever the fastener from the clip and then operating a second actuating means to completely depress the trigger to eject the fastener from the needle.

The method further includes the steps of providing first and second extendable rods. The first rod extends to partially depress the trigger. The second rod extends to completely depress the trigger.

The tool may include a knife blade. The step of partially depressing the trigger causes the fastener to bear against the knife blade to sever the fastener from the clip.

An abutment is provided in alignment with the trigger. The step of partially depressing the trigger includes the step of advancing the attacher toward to abutment. The abutment may be fixedly mounted. Alternatively, the extendable rod may act as the abutment. In that case, the rod is extended to completely depress the trigger.

In another embodiment, a first extendable rod is provided to partially depress the trigger. A second extendable rod is provided to completely depress the attacher trigger. Each of the rods forms as a part of a separate actuation means which may take the form of an electric solenoid or an pneumatic cylinder. The actuation means are operated in sequence. The method further comprises the step of automatically feeding tags, one at a time, to the attaching tool.

To these and to such other objects which may hereinafter appear, the present invention relates to a two-stage actuation system for a tag attaching tool, as set forth in detail in the following specification and as recited in the annexed claims, taken together with the accompanying drawings, in which like numerals refer to like parts and in which:

FIG. 3 is a side elevational view of a second preferred embodiment of the present invention utilizing a moveable abutment; and FIG. 4 is a front elevational view of a portion of a roll of directly connected fasteners.

Figure 1:
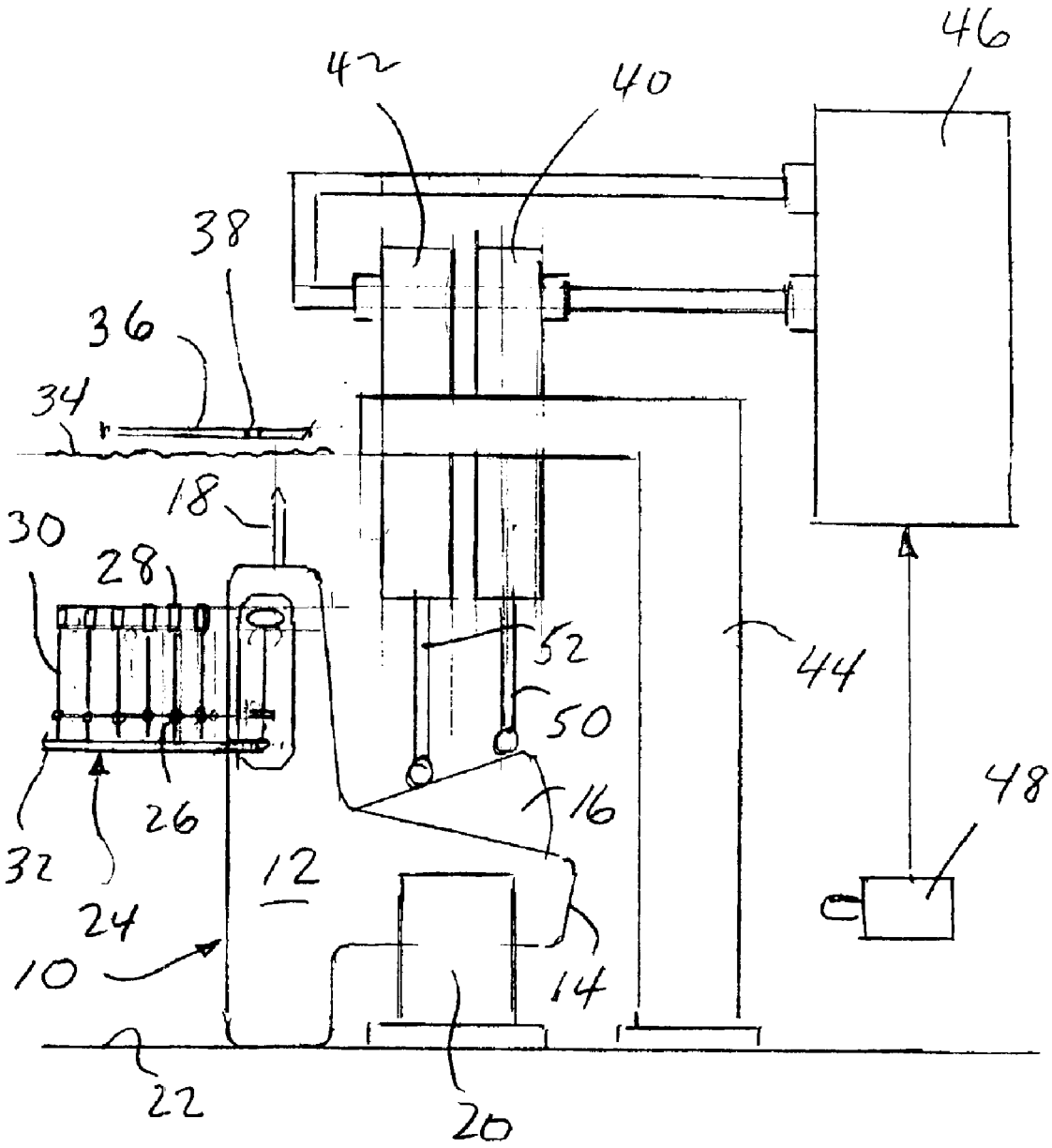
FIG. 1 is a side elevation view of a first preferred embodiment of the present invention.

FIG. 1 illustrates the two-stage actuation system as it would be used with a tag attaching tool 10 that is fixedly mounted on a work surface. Tool 10 can be any conventional tag attacher with a gun-shaped plastic body 12 including a handle 14 with a spring-loaded depressable trigger 16. A hollow slotted needle 18 extends from the front of body 12, as is conventional with this type of tool.

Tool 10 is mounted on a bracket 20 situated on work surface 22, commonly a table top. Tool 10 is held upright in a fixed position on the table top by bracket 20 such that needle 18 is substantially vertical, perpendicular to surface 22.

A supply of conventional polypropylene fasteners 24 is loaded into tool 10. Each fastener 24 includes a T-bar end 26, a paddle or T-bar end 28 and a thin filament 30 joining the T-bar end 26 and the other end 28. As illustrated, the T-bar ends 26 of the fasteners are connected by connecting elements at spaced points along a runner bar 32 to form a clip of twenty five or fifty fasteners, as is conventional. Alternatively, the fastener supply may include a roll of connected fasteners, which is also conventional.

When trigger 16 is depressed, a push rod (not shown) connected to the trigger by mechanical parts within the tool body causes the leading fastener to move toward the hollow needle 18. As fastener is moved, it severs the fastener from the clip. If the fasteners are connected on a runner bar, as in U.S. Pat. No. 3,103,666 to Bone, the rod pushes the fastener against a knife blade situated in the tool to sever the fastener. If the fasteners are on a roll, such as in U.S. Pat. No. 4,456,123 to Russell, as the rod advances, the force applied to the leading fastener breaks the connecting piece holding the adjacent fasteners together. The T-bar then travels along needle 18 and out the forward end of the needle, as the filament passes through the slot in the needle.

Prior to depressing the trigger, the article 34, to which a tag 36 is to be attached, is placed over the needle, in side by side relation with the tag 36. The tag often has a pre-punched opening 38 for this purpose. Tag 36 can be put over the needle manually, or by an automatic tag feed mechanism, including a reciprocating slide or a moveable vacuum feed arm, as disclosed in the previously mentioned patents, and illustrated schematically in FIG. 3.

As the T-bar end of the fastener exits the end of the needle, it rotates 90° such that it is perpendicular to the filament and is situated on one side of the article/tag assembly, parallel to the surface thereof. The other end of the fastener remains on the opposite side of the article/tag assembly. The filament extends through the hole in the article and opening 38 in the tag.

When a single stage power actuation mechanism is utilized, such as a single conventional pneumatic cylinder or a conventional electric solenoid, the force needed to sever the fastener from the clip during the first portion of the trigger depression cycle is frequently so high that the fastener is ejected so forcefully that the filament in a conventional polypropylene fastener will break at the point where it is joined to the T-bar. This problem is eliminated by the two-stage actuation system of the present invention which, in this preferred embodiment, includes a first actuation means 40, in the form of a first pneumatic cylinder or electric solenoid, and a second actuation means 42, in the form of a second pneumatic cylinder or electric solenoid. Actuation means 40 and 42 are both mounted in alignment with trigger 16, either above tool 10, as illustrated, by a bracket 44 mounted on work surface 22, or alongside the tool.

Actuation means 40, 42 are individually controlled and operated by a control circuit 46. The term "operated" as it is used herein refers to the energization of the cylinder by compressed air or the solenoid by electric current, depending upon the type of actuating means employed. The nature of the circuit 46 will depend upon the type of actuating means. It will regulate the compressed air supply or electric current separately to each, depending upon the nature of the actuation means, to operate the actuation means 40, 42 sequentially.

A switch 48, which may take the form of a foot pedal, is connected to circuit 46. Actuation of switch 48 causes circuit 46 to first operate means 40 by connecting it to a source of compressed air or electric current such that it extends rod 50 associated with it to partially depress trigger 16 causing the internal push rod (not shown) of the attaching tool to advance the leading fastener against the internal knife blade of the attaching tool to sever the fastener from the clip. At the appropriate time, determined by an adjustable timing circuit within control circuit 46, or by a limit switch (not shown) adjacent rod 50, operation of means 40 ceases and actuation means 42 is operated such that rod 52 associated with means 42 extends to depress trigger 16 completely, ejecting the T-bar of the leading fastener through the needle.

At the end of the movement of rod 52, operation of means 42 ceases by venting the supply line or terminating current flow, allowing the internal spring in trigger 16 to move trigger 16, and thus rods 50 and 52, back to their respective initial positions and to advance the next fastener 24 on the clip to a position in alignment with the rear of needle 18. The cylinders or solenoids that form the actuating means may have internal springs, or be "double acting" as well.

Since the actuation time and amount of compressed air to each cylinder or electric current to each solenoid can be separately regulated by circuit 46, the force applied during each stage of actuation, as well as the duration of each stage, can be easily controlled to eliminate breakage of the polypropylene fasteners. This eliminates the need for using more expensive nylon fasteners.

Figure 2:
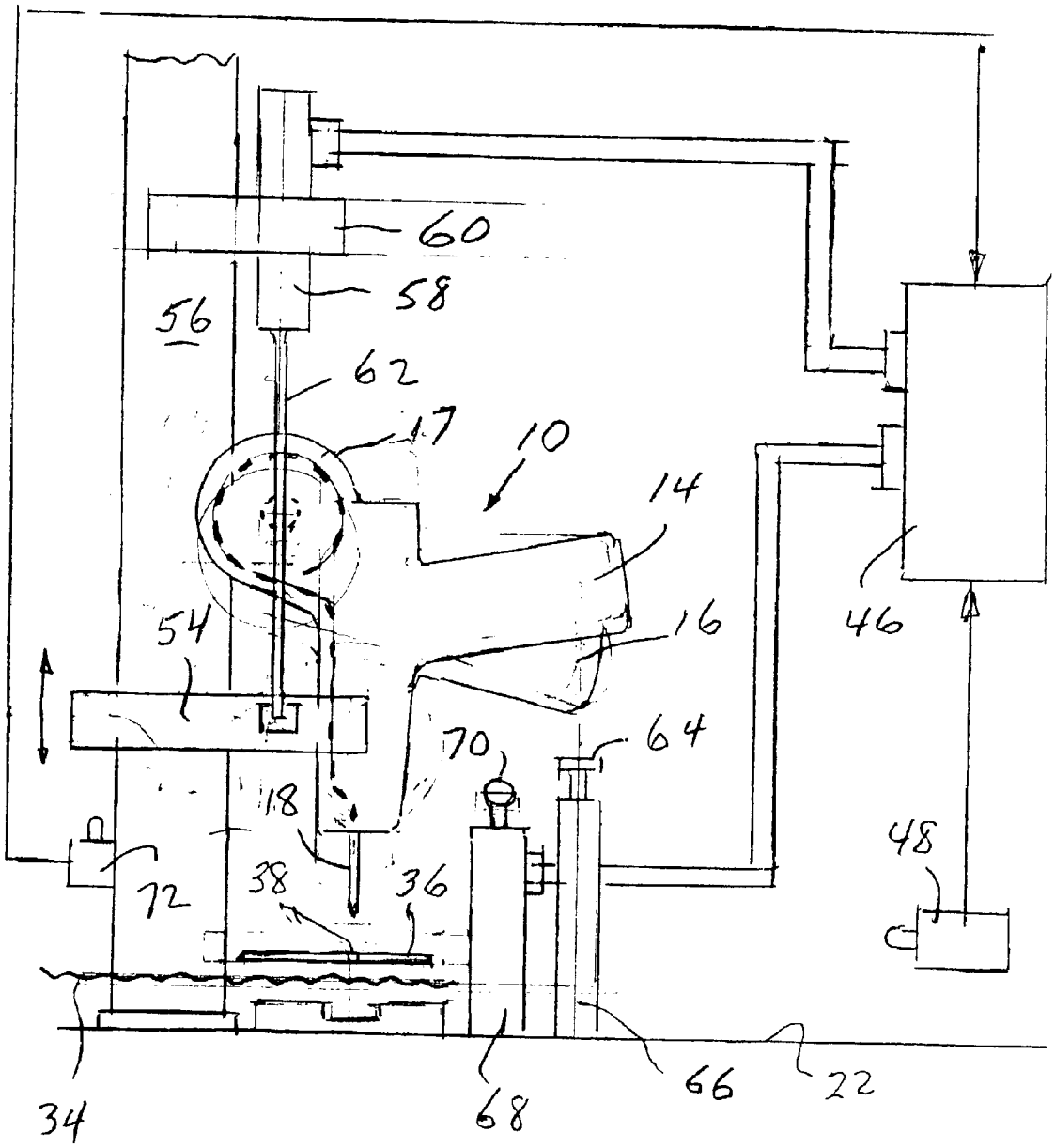
FIG. 2 is a side elevational view of a second preferred embodiment of the present invention utilizing a fixed abutment.

FIGS. 2 and 3 illustrate the use of the two-stage actuation system of the present invention with a tool 10 that is moveably mounted on the work surface 22. In these figures, the fasteners 80 are connected edge to edge by bridge elements to form a strip of fasteners provided to the attaching tool in a roll on a supply spool 17, as seen in FIG. 4. In each case, tool 10 is mounted on a bracket 54 which is moveable along a vertically extending guide post 56 situated on work surface 22. The first actuation means 58, in the form of a pneumatic cylinder or electric solenoid, is fixedly mounted to post 56 by bracket 60. The rod 62 of means 58 is connected to bracket 54.

In the embodiment of FIG. 2, a fixed abutment 64 is retained in alignment with trigger 16 by an upstanding post 66 mounted on surface 22. Abutment 64 is preferably formed with an externally threaded shaft that is received in an internally threaded opening in post 66 so as to be position adjustable. Adjacent post 66 on surface 22 is a second actuation means 68, in the form of a second pneumatic cylinder or electric solenoid, with an extendable rod 70. Rod 70 is also aligned with trigger 16. Actuation means 58 and 68 are operated sequentially by control circuit 46, through separate supply lines or electric wires.

When switch 48 is actuated, circuit 46 operates actuation means 58 by providing compressed air or electric current. Rod 62 extends causing bracket 54, and hence tool 10, to move downwardly along post 56. As tool 10 descends, needle 18 penetrates opening 38 in tag 36 and article 34 and trigger 16 bears against abutment 64 such that it is partially depressed. That causes the leading fastener to be severed from the clip.

At this point, bracket 54 trips a limit switch 72 on post 56 which causes circuit 46 to stop the downward movement of attacher 10 and to operate second actuation means 68 by providing compressed air or electric current to it. Rod 70 is thus caused to extend, depressing trigger 16 completely, ejecting the T-bar from needle 18. Both actuation means 58 and 68 are then deenergized, such that the internal springs in those cylinders or solenoids retract rods 62 and 70, moving tool 10 back up to its original position and releasing the trigger to advance the clip of fasteners to bring the next fastener into firing position. The tagged article is then removed.

FIG. 3 shows another embodiment of the two-stage actuation system that is set up for use with a moveably mounted attacher. This embodiment is structurally and operationally the same as that shown in FIG. 2, except that fixed abutment 64 and bracket 66 are eliminated and rod 70 functions as both an abutment, during the first actuation stage, and the means for completing the depression of the trigger, during the second stage.

In this case, as tool 10 is moved downwardly by actuation means 58, trigger 16 engages the end of rod 70 which partially depresses the trigger and actuates limit switch 72. Actuation of switch 72 causes circuit 46 to operate actuation means 68, causing rod 70 to extend and the depression of trigger 16 to be completed. After the actuation cycle is complete, the internal springs in means 58 and 68 return the tool 10 and rod 70 to their respective original positions, releasing the trigger to advance the clip within the tool.

Actuation means 68 can be mounted on work surface 22, or shown in FIG. 2 or on post 56, as shown on FIG. 3. If an automatic tag feed mechanism is utilized, such as the reciprocating tag carrying slide 72, slide 72 is connected to a means 74, which may take the form of a third pneumatic cylinder or electric solenoid, by an "L" shaped rod 76. In that case, it may be desirable to mount means 68 so that it does not interfere with the movement of the slide as it feeds a tag 36 from a hopper (not shown) to a position in alignment with needle 18. A vacuum arm type tag feed mechanism could be used instead of a reciprocating slide, if desired.

It will now be appreciated that the present invention relates to a two-stage tag attaching tool actuation system that eliminates the breakage of polypropylene fasteners as they are ejected from the tool. This is achieved by separating the fastener severing portion of the actuation cycle from the fastener ejection such that the force applied and duration of each portion of the actuation cycle can be individually controlled.

While only a limited number of preferred embodiments of the present invention have been disclosed for purposes of illustration, it is obvious that many variations and modifications could be made thereto. It is intended to cover all of these variations and modifications which fall within the scope of the invention, as defined by the following claims.

I claim:

1. Apparatus for actuating a tag attaching tool of the type which dispenses plastic fasteners from a clip in response to the depression of a trigger, each of the fasteners having a T-bar, the fasteners being dispensed by severing the fastener from the clip and ejecting the T-bar from a hollow slotted needle, said apparatus comprising means for actuating the tool in two actuating stages, said first actuation stage severing the fastener from the clip and said second actuation stage ejecting the fastener from the needle, wherein said tool actuating means comprises first actuating means for severing the fastener from the clip during said first actuation stage and said second actuating means for ejecting the T-bar through said second actuation stage, further comprising means for operating said first and said second actuating means in sequence, an abutment aligned with the attacher trigger and wherein said first actuating means comprises means for advancing the tool toward said abutment, wherein said abutment is fixed and wherein said second actuating means comprises an extendable rod aligned with the tool trigger and further comprising means for operating said second actuating means to extend said rod, said operating means comprising a switch actuated by the tool as it is advanced toward said abutment.

2. Apparatus for actuating a tag attaching tool of the type which dispenses plastic fasteners from a clip in response to the depression of a trigger, each of the fasteners having a T-bar, the fasteners being dispensed by severing the fastener from the clip and ejecting the T-bar from a hollow slotted needle, said apparatus comprising means for actuating the tool in two actuating stages, said first actuation stage severing the fastener from the clip and said second actuation stage ejecting the fastener from the needle, wherein said tool actuating means comprises first actuating means for severing the fastener from the clip during said first actuation stage and second actuating means for ejecting the T-bar through said second actuation stage, further comprising an abutment aligned with the attacher trigger and said first actuating means comprises means for advancing the tool toward said abutment, wherein said second actuating means comprises an extendable rod and wherein said rod comprises said abutment and wherein said second actuating means comprises a switch situated to be actuated by the tool as same is advanced toward said abutment.

3. Apparatus for actuating a tag attaching tool of the type which dispenses plastic fasteners from a clip in response to the depression of a trigger, each of the fasteners having a T-bar, the fasteners being dispensed by severing the fastener from the clip and ejecting the T-bar from a hollow slotted needle, said apparatus comprising means for actuating the tool in two actuating stages, said first actuation stage severing the fastener from the clip and said second actuation stage ejecting the fastener from the needle, wherein said tool actuating means comprises first actuating means for severing the fastener from the clip during said first actuation stage and second actuating means for ejecting the T-bar through said second actuation stage, means for operating said first and said second actuating means in sequence, a fixed abutment aligned with the attacher trigger and wherein said first actuating means comprises means for advancing the tool toward said abutment, means for operating said second actuating means to extend said rod, said operating means comprising a switch actuated by the tool as it is advanced toward said abutment, further comprising automatic means for feeding tags, one at a time, to the needle.

4. Apparatus for actuating a tag attaching tool of the type which dispenses plastic fasteners from a clip in response to the depression of a trigger, each of the fasteners having a T-bar, the fasteners being dispensed by severing the fastener from the clip and ejecting the T-bar from a hollow slotted needle, said apparatus comprising means for actuating the tool in two actuating stages, said first actuation stage severing the fastener from the clip and said second actuation stage ejecting the fastener from the needle, wherein said tool actuating means comprises first actuating means for severing the fastener from the clip during said first actuation stage and second actuating means for ejecting the T-bar through said second actuation stage, and an abutment aligned with the attacher trigger, wherein said first actuating means comprises means for advancing the tool toward said abutment and said second actuating means comprises an extendable rod, wherein said rod comprises said abutment and said second actuating means comprises a switch situated to be actuated by the tool as same is advanced toward said abutment, further comprising automatic means for feeding tags, one at a time, to the needle.

* * * * *